US011223908B1

(12) United States Patent
Jiang et al.

(10) Patent No.: US 11,223,908 B1
(45) Date of Patent: Jan. 11, 2022

(54) MICROPHONE STRUCTURE

(71) Applicant: MERRY ELECTRONICS (SHENZHEN) CO., LTD., Guangdong (CN)

(72) Inventors: Kai-Yu Jiang, Taichung (TW); Jen-Yi Chen, Taichung (TW); Yueh-Kang Lee, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 17/013,838

(22) Filed: Sep. 7, 2020

(30) Foreign Application Priority Data

Jun. 29, 2020 (TW) ..... 109121797

(51) Int. Cl.
*H04R 19/04* (2006.01)

(52) U.S. Cl.
CPC ..... *H04R 19/04* (2013.01); *H04R 2201/003* (2013.01)

(58) Field of Classification Search
CPC combination set(s) only.
See application file for complete search history.

(56) References Cited

U.S. PATENT DOCUMENTS 9,369,808 B2 * 6/2016 Chen ..... B81C 1/00182
9,374,644 B2 * 6/2016 Kasai ..... H04R 19/005
9,549,263 B2 * 1/2017 Uchida ..... H04R 19/005
2010/0212432 A1 * 8/2010 Kasai ..... H04R 19/005 73/654
2011/0278684 A1 * 11/2011 Kasai ..... H04R 19/005 257/416
2012/0213400 A1 * 8/2012 Kasai ..... H04R 19/04 381/369
2014/0126762 A1 * 5/2014 Zoellin ..... H04R 19/005 381/355
2015/0078592 A1 * 3/2015 Uchida ..... H04R 19/005 381/191
2015/0109889 A1 * 4/2015 Chen ..... H04R 19/005 367/189
2015/0264464 A1 * 9/2015 Okugawa ..... H04R 19/005 381/174
2015/0264476 A1 * 9/2015 Uchida ..... H04R 31/00 381/174
2015/0369653 A1 * 12/2015 Inoue ..... H04R 19/04 381/113
2018/0167740 A1 * 6/2018 Uchida ..... B81B 3/0072
2018/0249257 A1 * 8/2018 Kasai ..... B81B 3/001
2019/0342671 A1 * 11/2019 Jung ..... H04R 19/04
2020/0322731 A1 * 10/2020 Chen ..... H04R 7/06

* cited by examiner

*Primary Examiner* — Angelica M McKinney
(74) *Attorney, Agent, or Firm* — CKC & Partners Co., LLC

(57) ABSTRACT

A microphone structure includes a backplate, a diaphragm, a sidewall and at least one airflow retaining wall. The backplate has a plurality of through holes. The diaphragm has at least one slot. The sidewall is located between the backplate and the diaphragm such that the sidewall, the diaphragm and the backplate collectively define a chamber. The at least one airflow retaining wall protrudes from the backplate and is located within the chamber. The airflow retaining wall is positioned between the through holes and the slot, and has an uneven width.

9 Claims, 6 Drawing Sheets

100

MICROPHONE STRUCTURE

CROSS-REFERENCE TO RELATED APPLICATION

This application claims priority to Taiwan Application Serial Number 109121797, filed Jun. 29, 2020 which is herein incorporated by reference.

BACKGROUND

Field of Invention

The present disclosure relates to a microphone, and more particularly, to a MEMS (Micro-Electro-Mechanical System) microphone.

Description of Related Art

Slots or vent holes are needed on the diaphragm of the MEMS microphone to communicate the front and rear cavities to balance the cavity with the external atmospheric pressure, but the sound pressure is also dissipated. When the microphone receives low-frequency sound waves, due to the slow vibration speed of the diaphragm, the airflow can be easily flowed between the front and rear cavities, which makes the sound pressure dissipation more significant and causes the microphone's sensitivity to deteriorate at low frequencies. To solve this problem, the air leakage path is usually elongated or the opening of the path is formed smaller to reduce air leakage. In view of this, microphone suppliers are also actively seeking other better solutions.

SUMMARY

In one or more embodiments, a microphone structure includes a backplate, a diaphragm, a sidewall and at least one airflow retaining wall. The backplate has a plurality of through holes. The diaphragm has at least one slot. The sidewall is located between the backplate and the diaphragm such that the sidewall, the diaphragm and the backplate collectively define a chamber. The at least one airflow retaining wall protrudes from the backplate and is located within the chamber. The airflow retaining wall is positioned between the through holes and the slot, and has an uneven width.

In one or more embodiments, the airflow retaining wall has an irregular height.

In one or more embodiments, the airflow retaining wall has wavy side portions.

In one or more embodiments, the airflow retaining wall has a top containing a plurality of depressions.

In one or more embodiments, the diaphragm is a round diaphragm or a rectangular diaphragm, and the airflow retaining wall is an annular wall at a perimeter of the diaphragm.

In one or more embodiments, the airflow retaining wall has a cone-shaped cross section.

In one or more embodiments, the slot includes two arc-shaped slots that are at least partially parallel and adjacent to each other.

In one or more embodiments, the airflow retaining wall includes discontinuous arc-shaped retaining walls, and each arc-shaped retaining wall is located close to a corresponding parallel and adjacent section pair of the two arc-shaped slots.

In one or more embodiments, the at least one slot includes a plurality of arc-shaped slots located in a peripheral area and a central area of the diaphragm respectively.

In one or more embodiments, the at least one airflow retaining wall includes two ring-shaped retaining walls located in the peripheral area and the central area of the diaphragm respectively, and the through holes are located between the two ring-shaped retaining walls.

In one or more embodiments, the microphone structure further includes a plurality of convex cones located among the through holes, and the convex cones and the at least one airflow retaining wall share an equal height.

In sum, the microphone structure disclosed herein utilizes the airflow retaining wall to reduce the air velocity between the backplate through hole and the diaphragm through hole, thereby avoiding the problem of excessively rapid sound pressure dissipation. The airflow retaining wall also has uneven width, irregular height, conical section or discontinuous retaining wall, etc., which helps to avoid adhesion between backplate and diaphragm.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
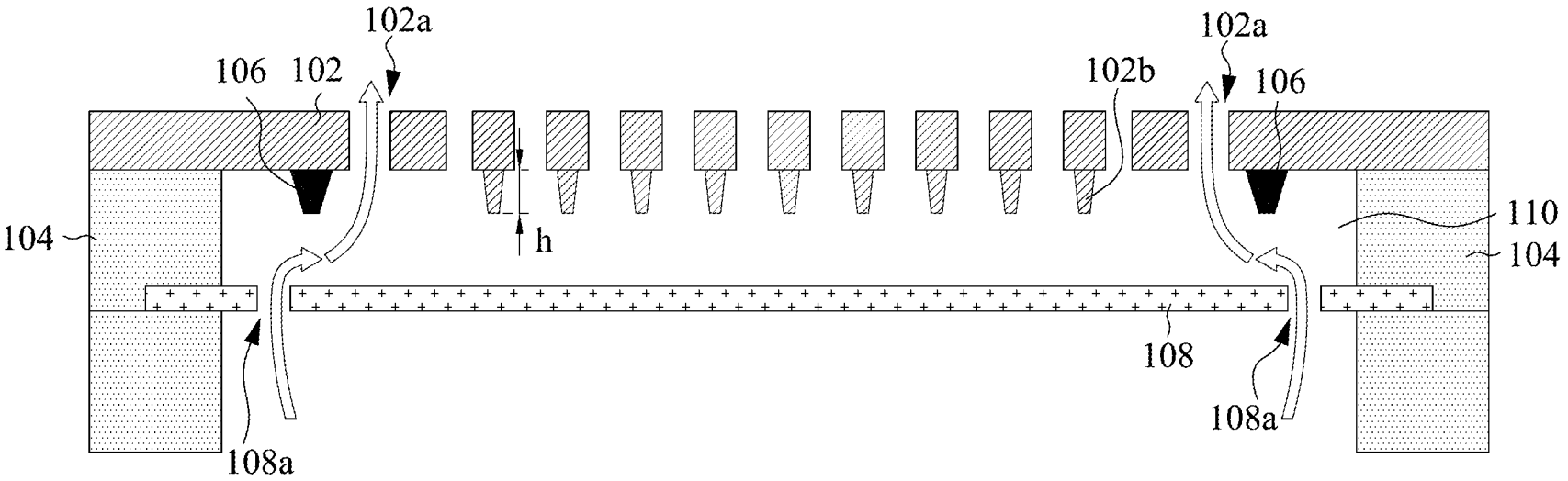
FIG. 1 illustrates a cross-sectional view of a microphone structure according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1, which illustrates a cross-sectional view of a microphone structure according to one embodiment of the present disclosure. A microphone structure 100 includes a backplate 102, a diaphragm 108, and a sidewall 104. The backplate 102 has plural through holes 102*a*. The diaphragm 108 has a slot 108*a*. The sidewall 104 is at least partially located between the backplate 102 and the diaphragm 108 so as to form a chamber 110 together with the diaphragm and the backplate. The airflow retaining wall 106 protrudes from the backplate 102 and is located in the chamber 110, and the airflow retaining wall 106 is located between the through holes 102*a* and the slot 108*a*. When the microphone receives sound pressure, the airflow retaining wall 106 reduces the rapid leakage of airflows.

In this embodiment of the present invention, the airflow retaining wall 106 has a cone-shaped cross section, but not being limited thereto. This design is used to reduce the contact area between a top of the airflow retaining wall 106 and the diaphragm 108, thereby avoiding adhesion between the backplate 102 and the diaphragm 108.

In this embodiment of the present invention, the backplate 102 further has a plurality of convex cones 102*b* located between the through holes 102*a*, and the convex cone 102*b* and the airflow retaining wall 106 have the same height h, but not being limited thereto. The plural convex cones 102*b* are used to avoid the adhesion between the backplate 102 and the diaphragm 108.

Figure 2:
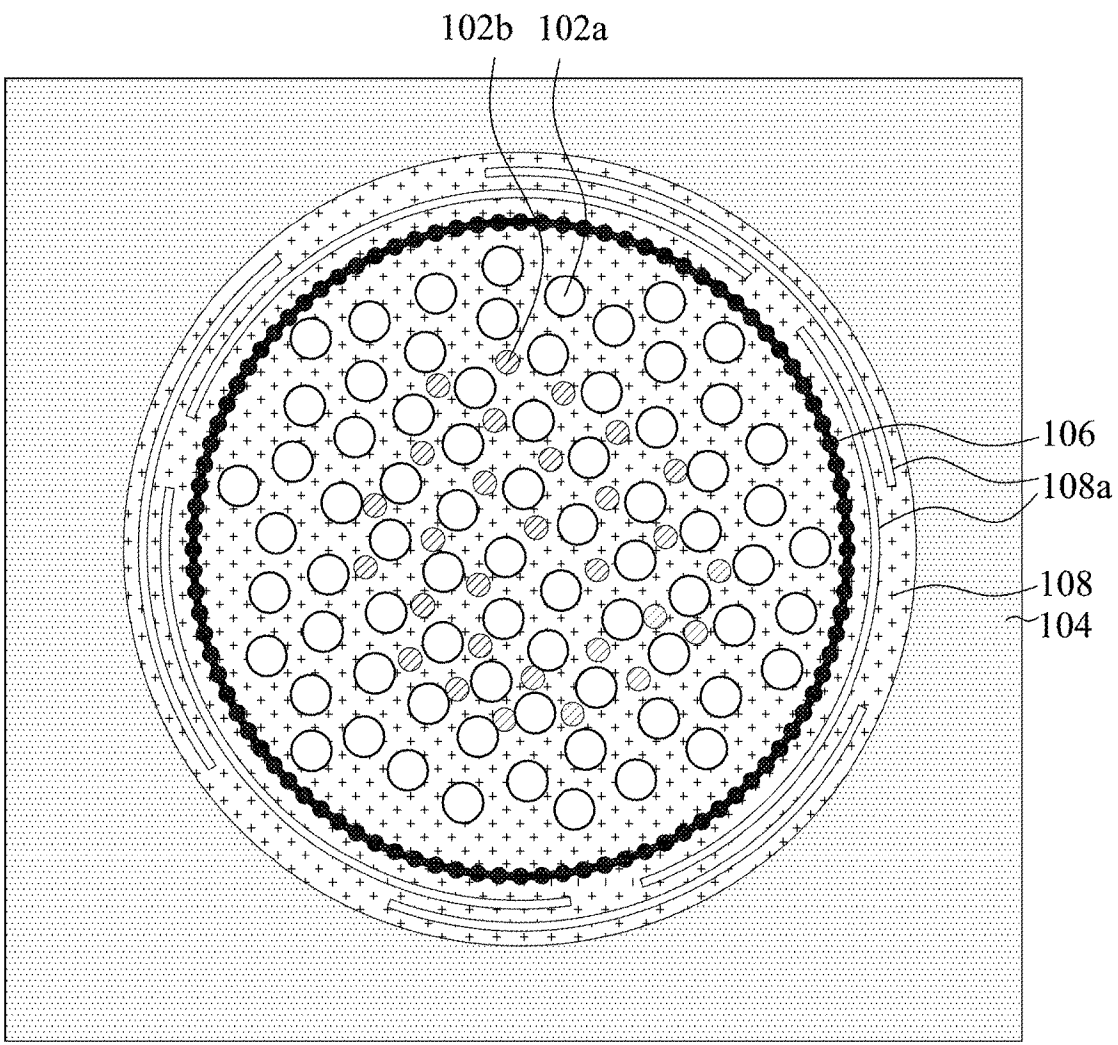
FIG. 2 illustrates a perspective planar view of a microphone structure according to one embodiment of the present disclosure.

Reference is made to FIG. 2, which illustrates a perspective planar view of a microphone structure according to one embodiment of the present disclosure. When the components in FIGS. 1 and 2 are compared, the backplate 102 is not shown in FIG. 2 to show a positional relationship between the through hole and the airflow retaining wall. In this embodiment of the present invention, the slot 108*a* includes a plurality of arc-shaped slots, and at least two arc-shaped slots 108*a* are at least partially parallel and adjacent to each other. Because the slots 108*a* arranged in parallel and in close proximity are the venting areas with more volume, the airflow retaining wall can effectively reduce the speed of air flow between the slot 108*a* and the through hole 102*a*, and avoid excessive sound pressure dissipation. The airflow retaining wall 106 has an uneven width, which reduces the contact area between the airflow retaining wall 106 and the diaphragm 108 to avoid adhesion between the backplate 102 and the diaphragm 108.

In this embodiment of the present invention, the diaphragm 108 is a round diaphragm, and the airflow retaining wall 106 is an annular retaining wall, which is arranged at a perimeter of the diaphragm 108.

Figure 3:
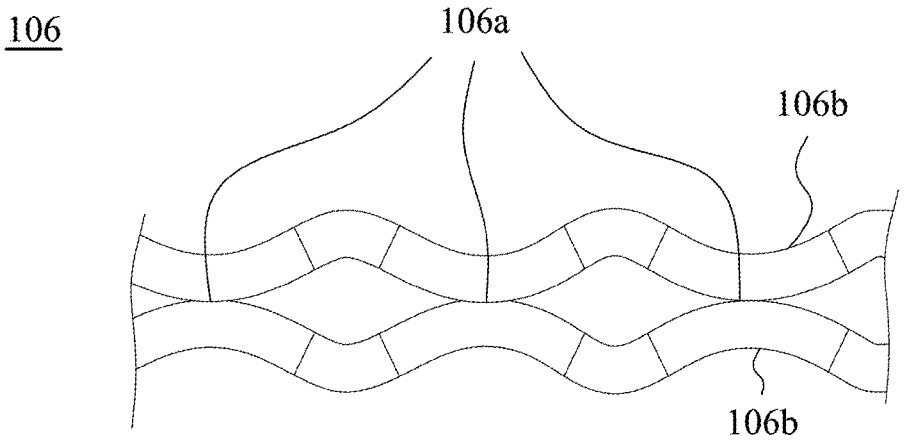
FIG. 3 illustrates a bottom view of an airflow retaining wall according to one embodiment of the present disclosure.
Figure 4:
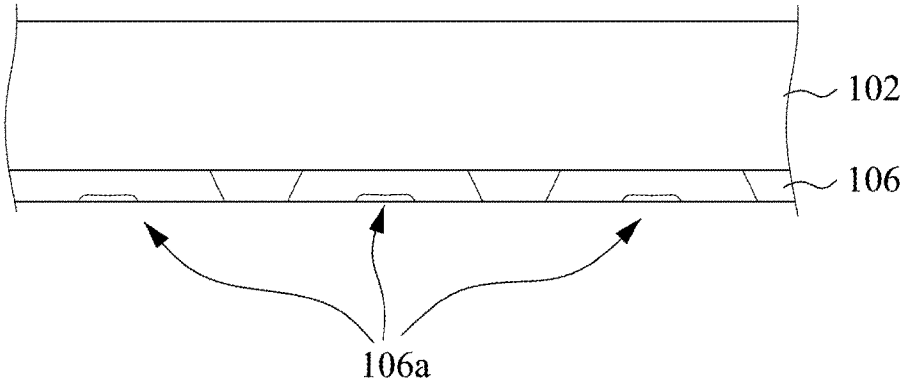
FIG. 4 illustrates a side view of an airflow retaining wall according to one embodiment of the present disclosure.

Reference is made to FIGS. 3 and 4. FIG. 3 illustrates a bottom view of an airflow retaining wall according to one embodiment of the present disclosure, and FIG. 4 illustrates a side view of an airflow retaining wall according to one embodiment of the present disclosure. In this embodiment of the present invention, the airflow retaining wall 106 has a wavy side portion 106*b* (referring to FIG. 3), but not being limited thereto. In this embodiment of the present invention, the airflow retaining wall 106 has an irregular height. For example, a top of the airflow retaining wall 106 includes a plurality of depressions 106*a* (referring to FIG. 4), but not being limited thereto. The structure of the aforementioned airflow retaining wall 106 also has the effect of avoiding adhesion between the backplate 102 and the diaphragm 108, and does not affect the effect of reducing air leakage.

Figure 5:
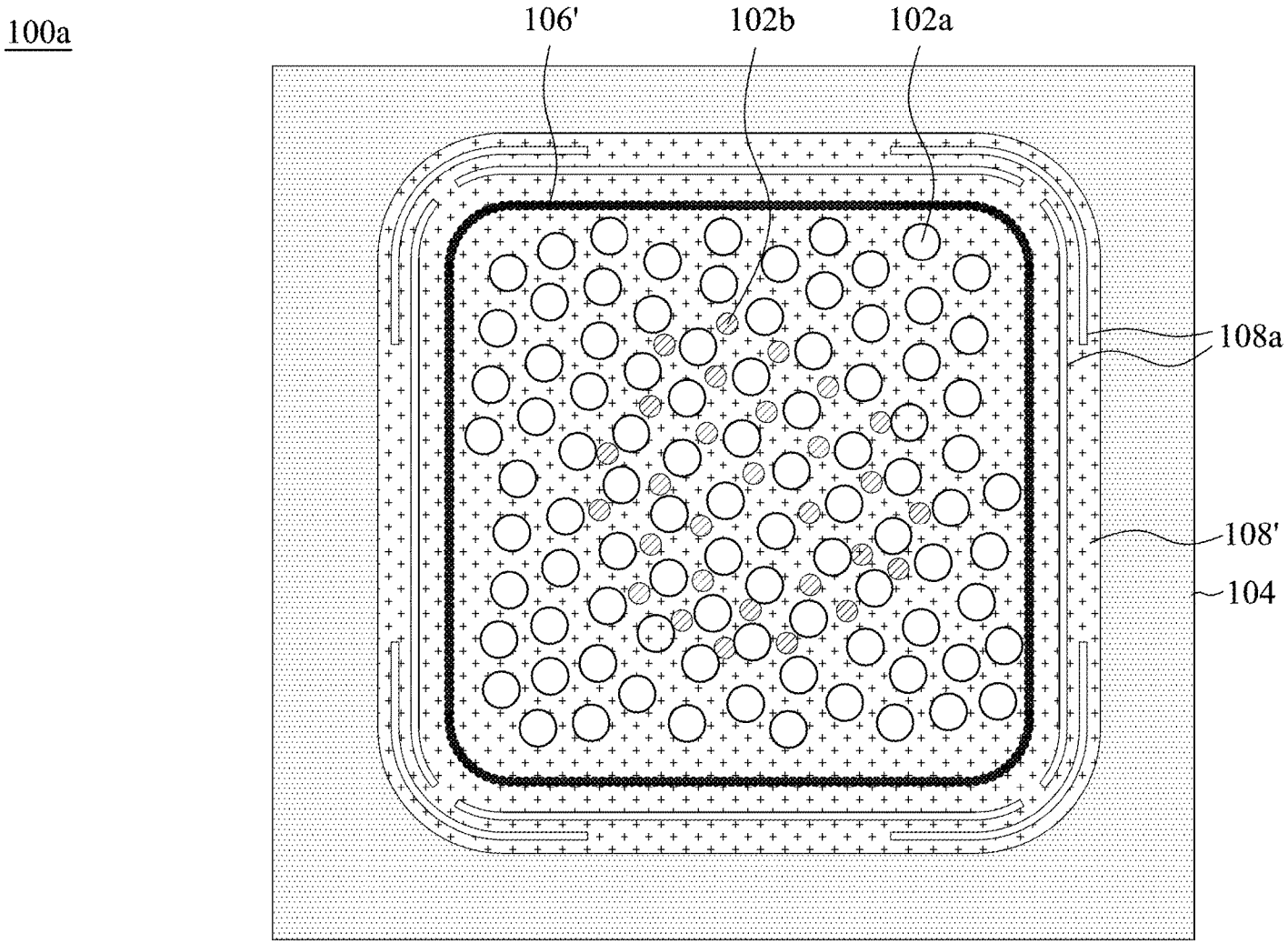
FIG. 5 illustrates a perspective planar view of a microphone structure according to another embodiment of the present disclosure.

Reference is made to FIG. 5, which illustrates a perspective planar view of a microphone 100*a* structure according to another embodiment of the present disclosure. Similar to FIG. 2, FIG. 5 does not show the backplate. The microphone structure 100*a* is different from the microphone structure 100 mainly in the shape of the diaphragm and the airflow retaining wall. In this embodiment of the present invention, the diaphragm 108' is a rectangular diaphragm, and the airflow retaining wall 106' is a rectangular ring retaining wall, which is arranged at a perimeter of the diaphragm 108'. The airflow retaining wall 106' also has a structure similar to the above-mentioned airflow retaining wall 106, so as to avoid adhesion between the backplate and the diaphragm.

Figure 6:
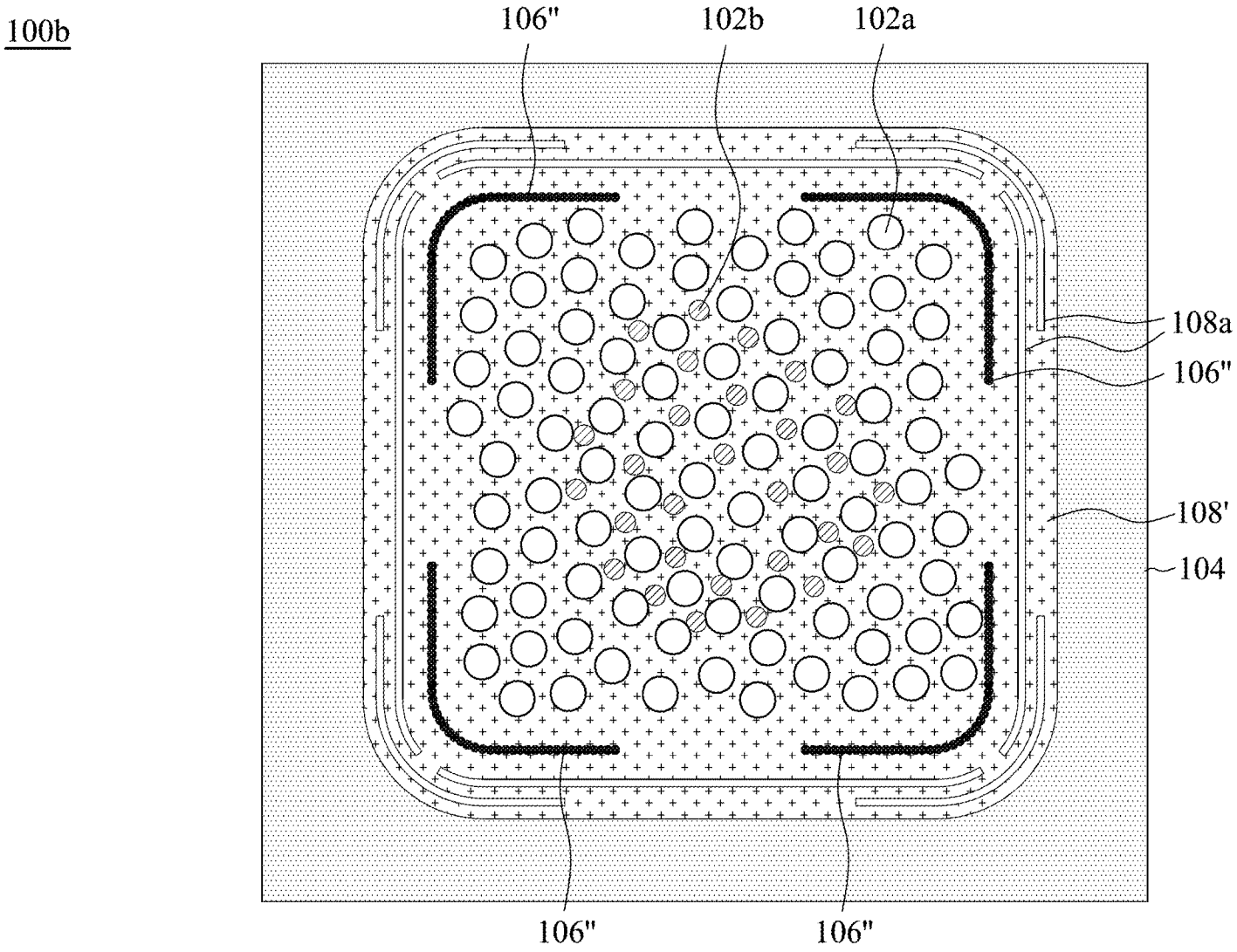
FIG. 6 illustrates a perspective planar view of a microphone structure according to still another embodiment of the present disclosure.

Reference is made to FIG. 6, which illustrates a perspective planar view of a microphone structure 100*b* according to still another embodiment of the present disclosure. Similar to FIG. 2, FIG. 6 does not show the backplate. The microphone structure 100*b* is different from the microphone structure 100*a* mainly in the design of the airflow retaining wall. In this embodiment of the present invention, the airflow retaining wall 106" includes four discontinuous arc-shaped retaining walls, and each arc-shaped retaining wall 106" is located close to a corresponding parallel and adjacent section pair of the two arc-shaped slots 108*a* (i.e., four corners of the rectangular diaphragm 108'), and located between the arc-shaped slots 108*a* and the through holes 102*a*. Since the slots 108*a* are arranged in parallel and close to each other at the corner areas, which are venting areas with more air leakage. The arrangement of the airflow retaining wall 106" will effectively reduce the speed of air flow between slot 108*a* and through hole 102*a*, and the discontinuous curved retaining walls 106" reduces a total length of the retaining wall and also helps to avoid the adhesion between the backplate 102 and the diaphragm 108.

Figure 7:
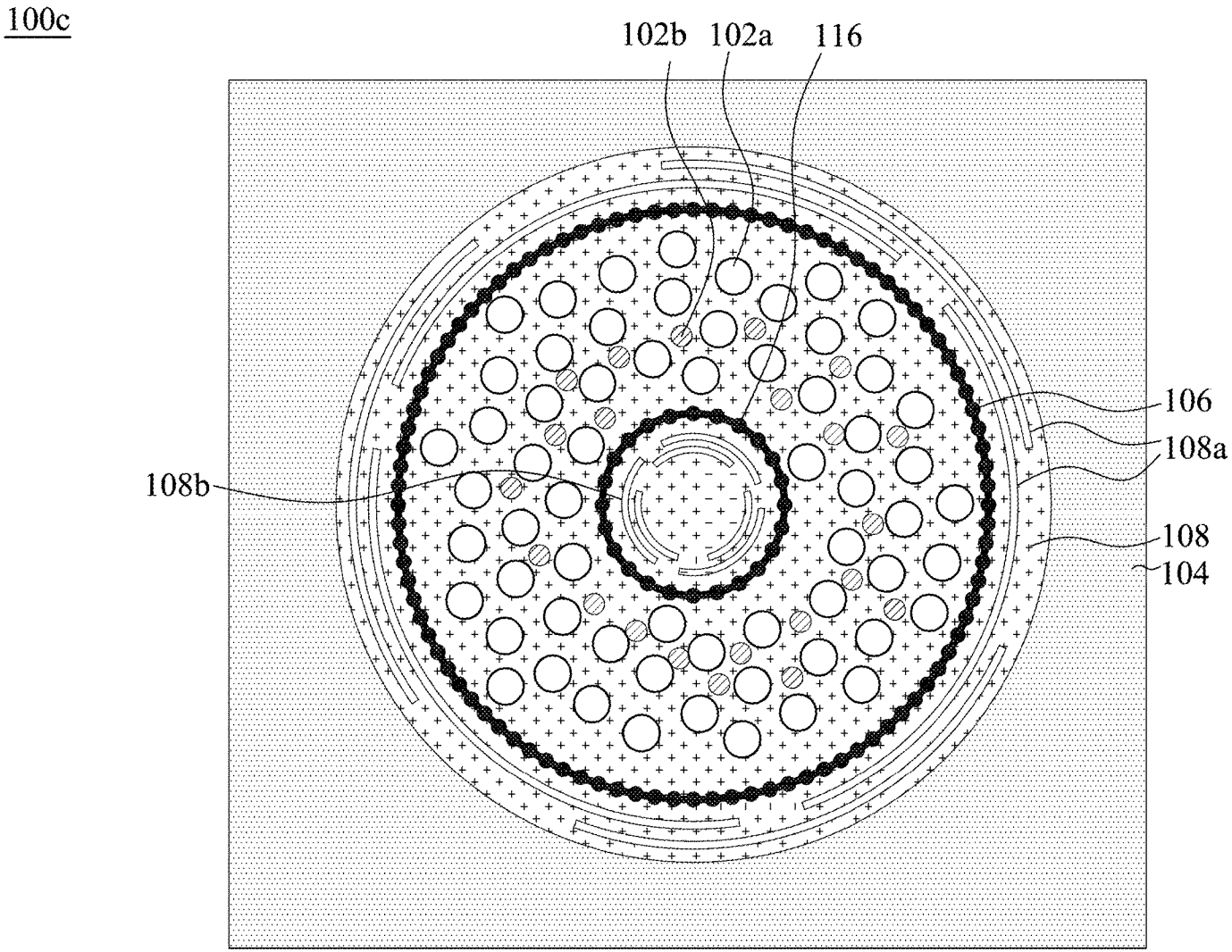
FIG. 7 illustrates a perspective planar view of a microphone structure according to still another embodiment of the present disclosure.

Reference is made to FIG. 7 which illustrates a perspective planar view of a microphone structure according to still another embodiment of the present disclosure. Similar to FIG. 2, FIG. 7 does not show the backplate. The microphone structure 100*c* is different from the microphone structure 100 mainly in the distribution of the airflow retaining wall. The microphone structure 100*c* includes two ring-shaped airflow retaining walls (106, 116), which protrude from the backplate (e.g., the backplate 102 in FIG. 1), and are arranged in the peripheral area and the central area of the circular diaphragm 108 respectively. The diaphragm 108 has a plurality of arc-shaped slots 108*a* in the peripheral area and a plurality of arc-shaped slots 108*b* in the central area. The airflow retaining wall 106 is located between the arc-shaped slots 108*a* and the through holes 102*a* of the backplate. The airflow retaining wall 116 is located between the arc-shaped slots 108*b* and the through holes 102*a* of the backplate. The through holes 102*a* of the backplate is distributed between the airflow retaining wall 106 and the airflow retaining wall 116. The arc-shaped slots 108*b* are correspondingly distributed within the area surrounded by the airflow retaining wall 116.

In summary, the microphone structure disclosed herein utilizes the airflow retaining wall to reduce the air velocity between the backplate through hole and the diaphragm through hole, thereby avoiding the problem of excessively rapid sound pressure dissipation. The airflow retaining wall also has uneven width, irregular height, conical section or discontinuous retaining wall, etc., which helps to avoid adhesion between backplate and diaphragm.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A microphone structure comprising:

a backplate having a plurality of through holes;

a diaphragm having at least one slot;

a sidewall disposed between the backplate and the diaphragm such that the sidewall, the diaphragm and the backplate collectively define a chamber;

at least one airflow retaining wall protruding from the backplate and disposed within the chamber, the airflow retaining wall is positioned between the through holes and the slot, and has an uneven width, wherein the at least one slot comprises two arc-shaped slots that are at least partially parallel and adjacent to each other, the at least one airflow retaining wall comprises discontinuous arc-shaped retaining walls, and each arc-shaped retaining wall is located close to a corresponding parallel and adjacent section pair of the two arc-shaped slots.

2. The microphone structure of claim 1, wherein the at least one airflow retaining wall has an irregular height.

3. The microphone structure of claim 1, wherein the at least one airflow retaining wall has wavy side portions.

4. The microphone structure of claim 1, wherein the at least one airflow retaining wall has a top containing a plurality of depressions.

5. The microphone structure of claim 1, wherein the diaphragm is a round diaphragm or a rectangular diaphragm, and the airflow retaining wall is an annular wall at a perimeter of the diaphragm.

6. The microphone structure of claim 1, wherein the at least one airflow retaining wall has a cone-shaped cross section.

7. The microphone structure of claim 1 further comprising a plurality of convex cones located among the through holes, and the convex cones and the at least one airflow retaining wall share an equal height.

8. A microphone structure comprising:

a backplate having a plurality of through holes;

a diaphragm having at least one slot;

a sidewall disposed between the backplate and the diaphragm such that the sidewall, the diaphragm and the backplate collectively define a chamber;

at least one airflow retaining wall protruding from the backplate and disposed within the chamber, the airflow retaining wall is positioned between the through holes and the slot, and has an uneven width, wherein the at least one slot comprises a plurality of arc-shaped slots located in a peripheral area and a central area of the diaphragm respectively.

9. The microphone structure of claim 8, wherein the at least one airflow retaining wall comprises two ring-shaped retaining walls located in the peripheral area and the central area of the diaphragm respectively, and the through holes are located between the two ring-shaped retaining walls.

* * * * *